US009376966B2

(12) United States Patent
Rabhi

(10) Patent No.: US 9,376,966 B2
(45) Date of Patent: Jun. 28, 2016

(54) ELECTROHYDRAULIC DEVICE FOR CLOSED-LOOP DRIVING THE CONTROL JACK OF A VARIABLE COMPRESSION RATIO ENGINE

(71) Applicant: Vianney Rabhi, Lyons (FR)

(72) Inventor: Vianney Rabhi, Lyons (FR)

( * ) Notice: Subject to any disclaimer, the term of this patent is extended or adjusted under 35 U.S.C. 154(b) by 0 days.

(21) Appl. No.: 14/449,451

(22) Filed: Aug. 1, 2014

(65) Prior Publication Data

US 2014/0338641 A1 Nov. 20, 2014

Related U.S. Application Data

(63) Continuation of application No. 12/596,378, filed as application No. PCT/FR2008/000529 on Mar. 16, 2008, now Pat. No. 8,875,671.

(60) Provisional application No. 60/907,776, filed on Apr. 17, 2007.

(30) Foreign Application Priority Data

Apr. 16, 2007 (FR) ..... 07 02732

(51) Int. Cl.
*F02D 15/02* (2006.01)
*F02B 75/04* (2006.01)

(52) U.S. Cl.
CPC ..... *F02D 15/02* (2013.01); *F02B 75/045* (2013.01); *F02B 75/048* (2013.01)

(58) Field of Classification Search
CPC ..... F02B 75/04; F02B 75/048; F02D 15/02
USPC ..... 123/48 R, 48 A, 90.12
See application file for complete search history.

(56) References Cited

U.S. PATENT DOCUMENTS

| | | | | |
|---|---|---|---|---|
| 2,971,536 | A | 2/1961 | Junck et al. | |
| 5,136,987 | A | 8/1992 | Schechter et al. | |
| 6,125,817 | A | 10/2000 | Piock et al. | |
| 6,354,252 | B1 | 3/2002 | Rabhi | |
| 7,021,254 | B2 * | 4/2006 | Shiraishi et al. | 123/78 E |
| 7,562,642 | B2 | 7/2009 | Rabhi | |
| 2005/0028762 | A1 | 2/2005 | Shiraishi et al. | |

(Continued)

FOREIGN PATENT DOCUMENTS

| | | |
|---|---|---|
| EP | 1418322 A2 | 5/2004 |
| EP | 1496219 A1 | 1/2005 |

(Continued)

OTHER PUBLICATIONS

International Search Report for International Application No. PCT/FR2008/000529 dated Feb. 4, 2009, 8 pages.

(Continued)

*Primary Examiner* — Lindsay Low
*Assistant Examiner* — Kevin Lathers
(74) *Attorney, Agent, or Firm* — TraskBritt

(57) ABSTRACT

An electrohydraulic device for controlling the compression ratio of a variable compression-ratio engine, includes at least one dual-flow electrovalve with no check valve and capable of opening and closing at least one hydraulic fluid duct between an upper chamber and a lower chamber of a control jack, at least one position sensor of a control rack, an angular position sensor of the crankshaft of the engine for adjusting the compression ratio, and at least one calculator.

19 Claims, 3 Drawing Sheets

(56) References Cited

U.S. PATENT DOCUMENTS

| | | | | |
|---|---|---|---|---|
| 2008/0087255 | A1* | 4/2008 | Aoyama et al. | 123/48 B |
| 2009/0205615 | A1* | 8/2009 | Cannata | F02B 75/044 123/48 B |
| 2009/0320803 | A1 | 12/2009 | Simpson | |

FOREIGN PATENT DOCUMENTS

| | | | |
|---|---|---|---|
| FR | 2763097 | A | 11/1998 |
| JP | 2002317663 | A | 10/2002 |
| JP | 2004150353 | A | 5/2004 |
| WO | 9851911 | A1 | 11/1998 |
| WO | 0031377 | A1 | 6/2000 |
| WO | 03008783 | A1 | 1/2003 |
| WO | 2007085737 | A2 | 8/2007 |
| WO | 2007085739 | A2 | 8/2007 |
| WO | 2007085740 | A1 | 8/2007 |

OTHER PUBLICATIONS

International Written Opinion for International Application No. PCT/FR2008/000529 dated Feb. 4, 2009, 5 pages.

International Preliminary Report on Patentability for International Application No. PCT/FR2008/00529 dated Oct. 20, 2009, 6 pages.

* cited by examiner

ELECTROHYDRAULIC DEVICE FOR CLOSED-LOOP DRIVING THE CONTROL JACK OF A VARIABLE COMPRESSION RATIO ENGINE

CROSS-REFERENCE TO RELATED APPLICATIONS

This application is a continuation of U.S. patent application Ser. No. 12/596,378, filed Mar. 5, 2010, now U.S. Pat. No. 8,875,671, issued Nov. 4, 2014, which application is a national phase entry under 35 U.S.C. §371 of International Patent Application PCT/FR2008/00529, filed Apr. 16, 2008, which claims priority to U.S. Provisional Patent Application Ser. No. 60/907,776, filed Apr. 17, 2007, and to French Patent Application Serial No. 07/02732, filed Apr. 16, 2007, the disclosure of each of which is hereby incorporated herein in its entirety by this reference.

TECHNICAL FIELD

The subject of the present invention is an electrohydraulic device for closed-loop control of the control jack of a variable compression ratio engine comprising at least one hydraulic transfer valve and one control rack position sensor.

BACKGROUND

According to international patents WO 98/51911, WO 00/31377 and WO 03/008783 belonging to the applicant, various mechanical devices for a variable displacement engine are known.

It is noted that international patent WO 98/51911 in the name of the applicant describes a device used to enhance the overall efficiency of internal combustion engines with pistons used at variable load and speed by in-operation adaptation of their effective displacement and/or of their volumetric ratio. Since this type of engine is known to those skilled in the art by the name "variable compression ratio engine," this name will be adopted in the following text.

It is noted that, according to international patent WO 00/31377 in the name of the applicant, the mechanical transmission device for a variable compression ratio engine comprises a piston that is secured in its bottom portion to a transmission member interacting, on the one hand, with a rolling guidance device and, on the other hand, with a gearwheel secured to a connecting rod making it possible to transmit the movement between the piston and the connecting rod.

It is noted that, according to international patent WO 03/008783 in the name of the applicant, the mechanical transmission device for a variable compression ratio engine comprises at least one cylinder in which a piston moves, which is secured, in its lower portion, to a transmission member interacting on the one hand via a small-dimension rack with a rolling guidance device and, on the other hand, by means of another large-dimension rack, with a gearwheel secured to a connecting rod.

The mechanical transmission device for a variable compression ratio engine also comprises at least one control rack interacting with the gearwheel, means for attaching the piston to the transmission member, which offers a clamping prestress, connection means that makes it possible to stiffen the teeth of the racks, and means for reinforcing and lightening the structure of the gearwheel.

It is observed that according to international patents WO 98/51911 and PCT/FR2007/000149, the compression ratio of the variable compression ratio engine is regulated by means of a control hydraulic jack, the movement of which is provided by the forces resulting from the inertia of the moving parts and from the pressure of the engine gases that are applied to the control rack to which the jack is secured. According to these patents, it is noted that the position of the control jack always follows that of a control rod, which acts on the opening or closing of valves that are in contact with the top and bottom faces of the piston of the control jack. The valves allow the hydraulic fluid to pass from the top chamber to the bottom chamber of the control jack, or vice versa, either to decrease or increase the compression ratio of the variable compression ratio engine. Patents PCT/FR2007/000150 and PCT/FR2007/000147 describe a number of variants making it possible to regulate the position of the control rod by means of one or more electric motors controlled by at least one computer.

It is also noted that, according to patent PCT/FR2007/000149, the control jack comprises a pressurized hydraulic fluid inlet provided to compensate for any leaks from the control jack, and to provide a preload pressure for the purpose of increasing the accuracy of retention of the setpoint in the vertical position of the control jack by reducing the effects of the compressibility of the oil while preventing any cavitation phenomenon.

As claimed in international patent application PCT/FR2007/000147 in the name of the applicant, a single electric motor can control the compression ratio of several cylinders via a cam or eccentric shaft. In this same patent, it is seen that the regulation of the initial compression ratio of each cylinder may be carried out by means of an independent regulation device that can be a threading immobilized in rotation.

DISCLOSURE

The electrohydraulic device for closed-loop control of the control jack according to the invention makes it possible to solve a set of problems associated with controlling the control cylinder(s) of the variable compression ratio engine:

- The valves, and their springs, and the control rod involve providing a considerable diameter for the control jack, these components being housed in the periphery of the piston of the jack. This reduces the operating pressure and the responsiveness of the control jack, increases the transfer flow rates of hydraulic fluid between the top chamber and bottom chamber and increases the space requirement and weight of the control jack assembly.
- The independent control of the compression ratio of each control jack of the engine is difficult to achieve because, in this case, it is necessary to provide an electric actuator for each of the control rods, each actuator being connected to its control rod by specific transmission means.
- The compression ratio control that is common to all the cylinders of the variable compression ratio engine involves transmission means between an electric motor for controlling the compression ratio and the control rods of each cylinder of the variable compression ratio engine, and regulation means specific to each cylinder. These members increase the space requirement, the weight and the cost price of the variable compression ratio engine.

It is, therefore, in order to reduce significantly the space requirement, the cost and the weight and to increase the responsiveness and precision of the control of the compression ratio of the variable compression ratio engine that the device according to the invention makes it possible:

to delete the control rod and its guidance and sealing means and the valves and the springs with which it interacts;

to reduce the diameter and the displacement of the jack piston for the same travel for controlling the compression ratio;

to delete the electric motor for controlling the compression ratio and the transmission and regulation means that are associated therewith and that link it with the control rod.

The electrohydraulic device for controlling the compression ratio of a variable compression ratio engine according to the present invention comprises at least one electrovalve that can open or close at least one hydraulic fluid duct between the top chamber and bottom chamber of a control jack, at least one position sensor of a control rack, an angular position sensor of the crankshaft of the engine in order to regulate the compression ratio and at least one computer.

The electrohydraulic device for controlling the compression ratio of a variable compression ratio engine according to the present invention comprises a duct between the top chamber and bottom chamber of the control jack, which is arranged in the piston of the jack.

The electrohydraulic device for controlling the compression ratio of a variable compression ratio engine according to the present invention comprises a duct between the top chamber and bottom chamber of the control jack, which is arranged in the cylinder block of the variable compression ratio engine.

The electrohydraulic device for controlling the compression ratio of a variable compression ratio engine according to the present invention comprises a top chamber and a bottom chamber of the control jack that are respectively supplied with hydraulic fluid under pressure from a hydraulic unit via two booster check valves that open respectively into each of the two chambers and that allow the hydraulic fluid to enter the chambers while preventing it from leaving the chambers.

The electrohydraulic device for controlling the compression ratio of a variable compression ratio engine according to the present invention interacts with a ping detector in order to independently regulate the compression ratio of each cylinder of the engine according to its own physical characteristics.

The electrohydraulic device for controlling the compression ratio of a variable compression ratio engine according to the present invention comprises a degassing electrovalve making it possible to link the top chamber of the control jack with the oil pan of the engine.

The electrohydraulic device for controlling the compression ratio of a variable compression ratio engine according to the present invention comprises a two-way electrovalve comprising no check valve.

BRIEF DESCRIPTION OF THE DRAWINGS

The following description with respect to the appended drawings, given as nonlimiting examples, will make it possible to better understand the invention, the features that it has and the advantages that it is capable of providing.

DETAILED DESCRIPTION

Figure 1:
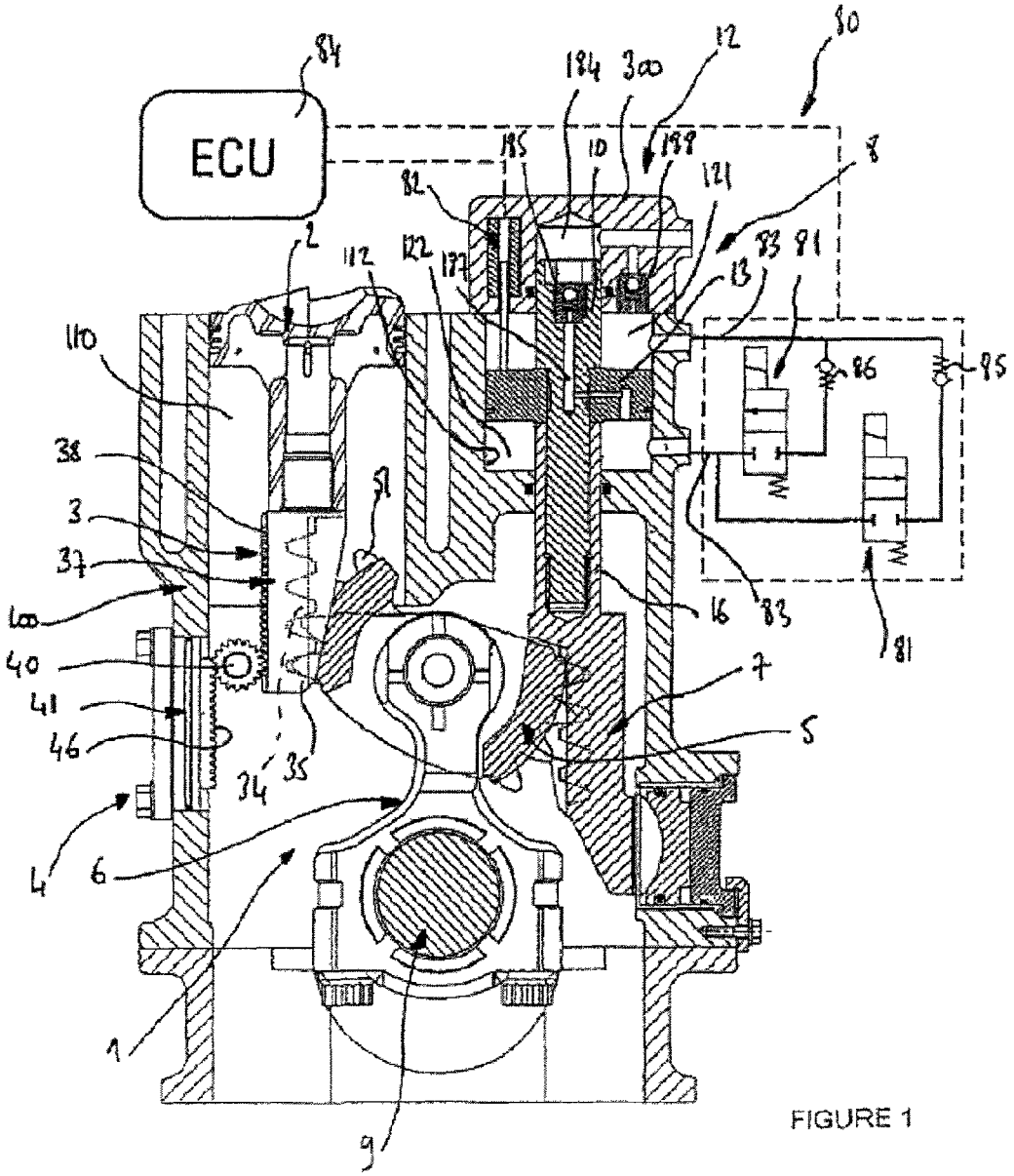
FIG. 1 is a schematic view in section illustrating the main components and their positioning in the variable compression ratio engine of the electrohydraulic device according to the invention and according to a first variant embodiment that comprises two independent electrovalves each placed on a circuit furnished with a check valve, the electrovalves interacting with a sensor for sensing the position of the control rack and a computer.
Figure 2:
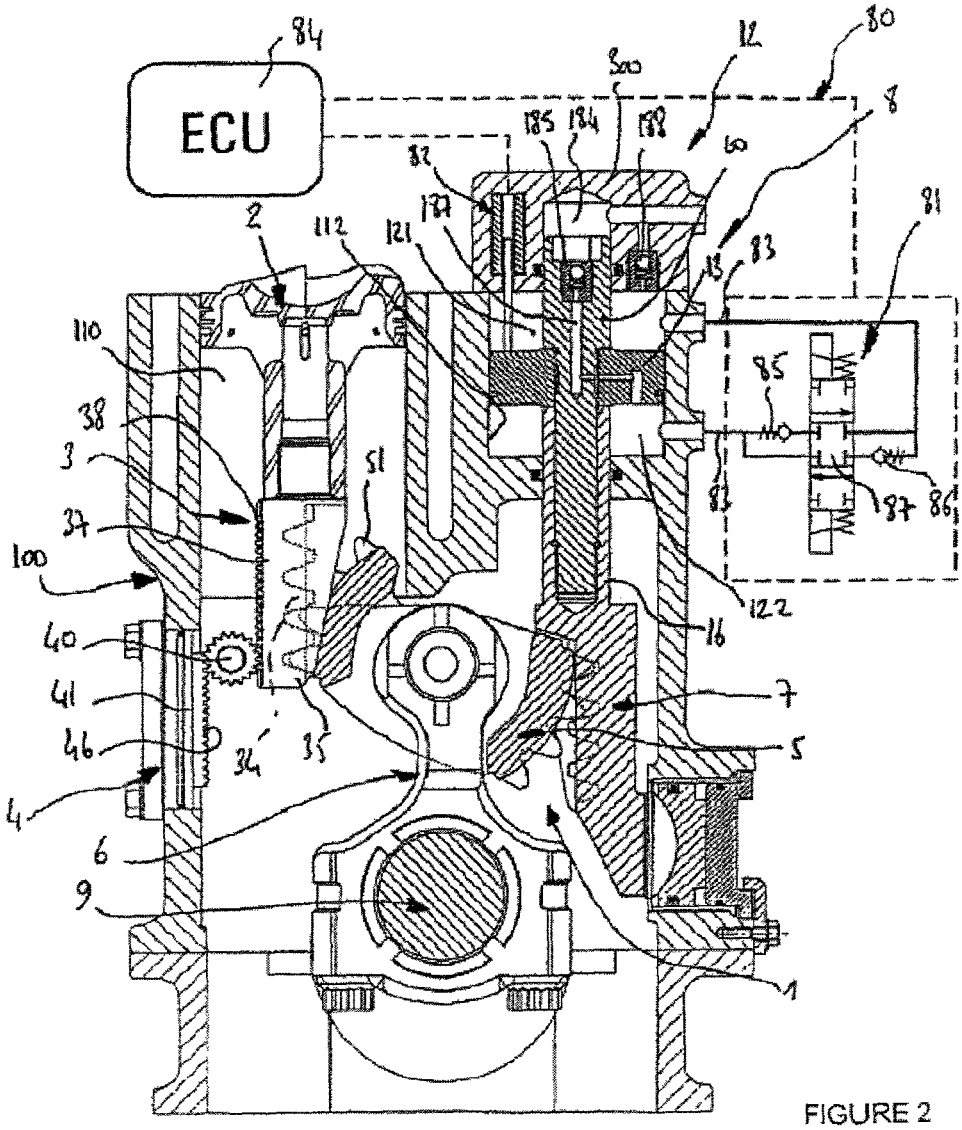
FIG. 2 is a schematic view in section illustrating the main components and their positioning in the variable compression ratio engine of the electrohydraulic device according to the invention and according to a second variant embodiment that comprises a single electrovalve comprising an electrically controlled spool with two inlets and two separate outlets defining two independent circuits, each furnished with a check valve, the electrovalve interacting with a sensor for sensing the position of the control rack and a computer.
Figure 3:
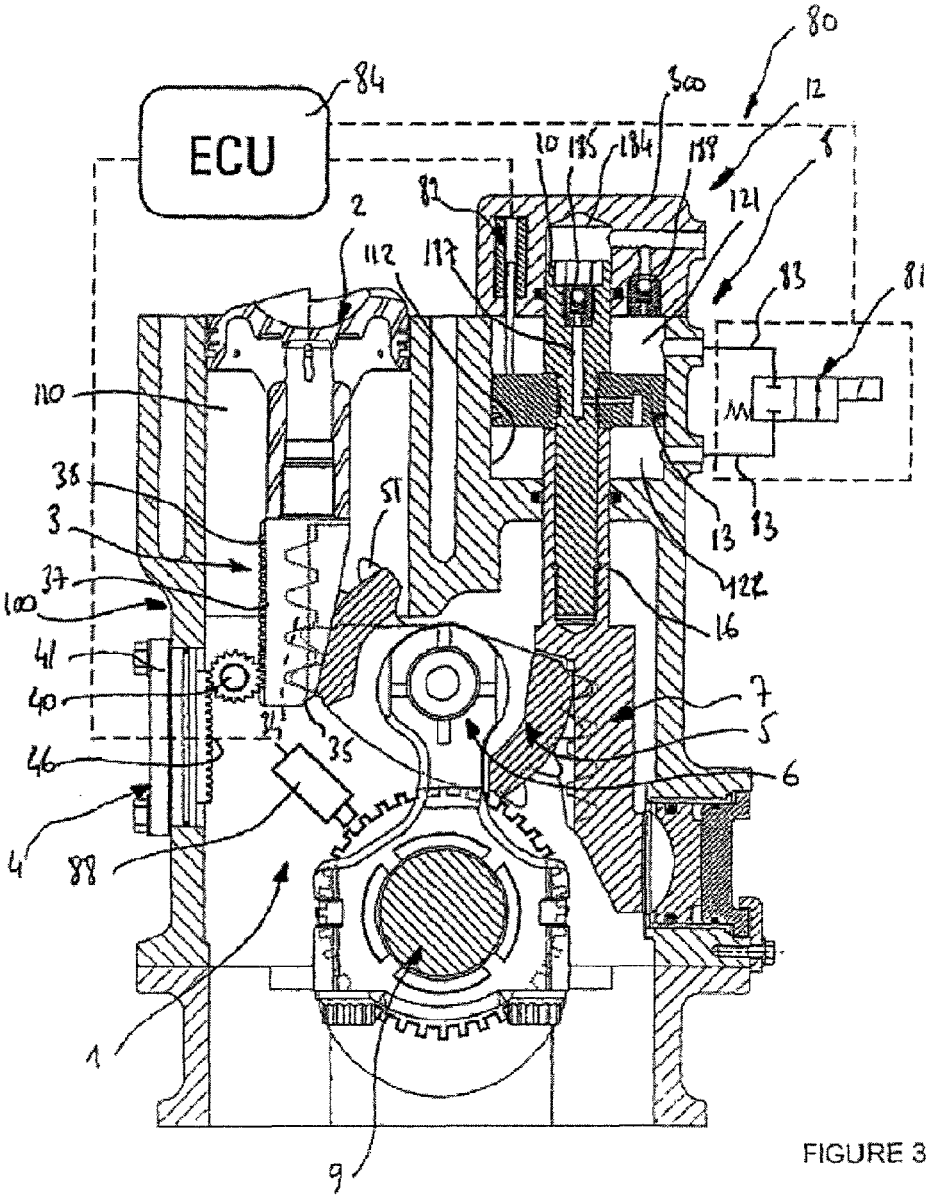
FIG. 3 is a schematic view in section illustrating the main components and their positioning in the variable compression ratio engine of the electrohydraulic device according to the invention and according to a third variant embodiment that comprises a single electrovalve interacting with a sensor for sensing the position of the control rack, a sensor of the angular position of the crankshaft of the variable compression ratio engine, and a computer.

FIGS. 1 to 3 show an electrohydraulic device 80 for closed-loop control of the control cylinder 8 of a variable compression ratio engine according to the present invention.

According to the patent applications and inventive patents belonging to the applicant, the variable compression ratio engine comprises a mechanical transmission device 1 comprising in the bottom portion of the piston 2, a transmission member 3 secured to the piston 2 and interacting, on the one hand, with a rolling guidance device 4, and on the other hand, with a gearwheel 5.

The gearwheel 5 interacts with a connecting rod 6 connected to the crankshaft 9 in order to transmit the movement between the piston 2 and the crankshaft 9.

The gearwheel 5 interacts opposite to the transmission member 3 with a control rack 7, the vertical position of which relative to the cylinder block 100 is controlled by a control device 12 comprising the control jack 8, the cylinder piston 13 of which is guided in a jack cylinder 112 arranged in the cylinder block 100.

The control jack 8 comprises, above and below the jack piston 13, a top chamber 121 and a bottom chamber 122. The control jack 8 consists of a top jack rod 10 and a bottom jack rod 16 interacting with the jack piston 13.

The top jack rod 10 of the control jack 8 interacts in its extension and in a sealed manner with a chamber 184 arranged in the cylinder head 300 of the variable compression ratio engine.

The top jack rod 10 may comprise in its inner portion and in its center a booster check valve 185, the inlet of which is in communication with the chamber 184 arranged in the cylinder head 300 of the control jack 8, while the outlet from the booster check valve 185 is connected to a duct 187 arranged in the jack piston 13 of the control jack 8 and emerging into the bottom chamber 122.

The chamber 184 arranged in the cylinder head 300 is connected via a duct to another booster check valve 188 housed in the cylinder head 300 and communicating with the top chamber 121 of the control jack 8.

Therefore, the top chamber 121 and the bottom chamber 122 of the control jack 8 are respectively supplied with hydraulic fluid under pressure from a hydraulic unit via the two booster check valves 185, 188 that open respectively into each of the two chambers 121, 122 and that allow the hydraulic fluid to enter the chambers 121, 122 while preventing them from leaving the chambers 121, 122.

The transmission member 3 secured to the piston 2 is provided on one of its faces with a first large-dimension rack 35, the teeth 34 of which interact with teeth 51 of the gearwheel 5.

The transmission member 3 comprises, opposite to the first rack 35, a second rack 37, the small-dimension teeth 38 of which interact with those of a roller 40 of the rolling guidance device 4.

The cylinder block 100 is secured to a support 41 comprising racks 46 synchronizing the movement of the roller 40 of the rolling guidance device 4 with that of the piston 2.

The electrohydraulic device 80 for controlling the compression ratio of the variable compression ratio engine comprises at least one electrovalve 81 per control jack 8 that can open or close at least one duct 83 of hydraulic fluid between the top chamber 122 and bottom chamber 121 of the control jack 8.

The controlling electrohydraulic device 80 comprises, in the cylinder head 300 and at each control jack 8, at least one position sensor 82 making it possible to determine, with the aid of at least one computer 84, the position of the control rack 7.

The electrohydraulic device 80 for controlling the compression ratio of a variable compression ratio engine comprises a duct 83 between the top chamber 121 and bottom chamber 122 of the control jack 8, which is arranged in the jack piston 13 of the control jack 8.

As a variant, the duct 83 between the top chamber 121 and bottom chamber 122 of the control jack 8 may be arranged in the cylinder block 100 of the variable compression ratio engine.

The electrohydraulic device 80 for controlling the compression ratio of a variable compression ratio engine comprises two electrovalves 81 at an inlet and an outlet that can each open or close the duct 83 connecting the top chamber 121 to the bottom chamber 122 of the control jack 8, as illustrated in FIG. 1.

Each electrovalve 81 comprises a check valve 85, 86 so that the check valve 85 of the first electrovalve 81 prevents the hydraulic fluid from going from the top chamber 121 to the bottom chamber 122 of the control jack 8 but not the reverse, while the check valve 86 of the second electrovalve 81 prevents the hydraulic fluid from going from the bottom chamber 122 to the top chamber 121 of the control jack 8 but not the reverse.

FIG. 2 illustrates a second variant of the electrohydraulic device 80 for controlling the compression ratio of a variable compression ratio engine that comprises an electrovalve 81 comprising two inlets and two outlets that define two independent circuits, and a three-position spool 87 making it possible either to connect the first inlet to the first outlet, with the second inlet being closed off, or to connect the second inlet to the second outlet, with the first inlet being closed off, or to close off both inlets.

In this embodiment, the electrovalve 81 with electrically controlled spool 87 comprises two check valves 85, 86, the first check valve 85 preventing the hydraulic fluid from going from the top chamber 121 to the bottom chamber 122 of the control jack 8 but not the reverse, while the second check valve 86 prevents the hydraulic fluid from going from the bottom chamber 122 to the top chamber 121 of the control jack 8 but not the reverse.

FIG. 3 shows a third variant of the electrohydraulic device 80 for controlling the compression ratio of a variable compression ratio engine that consists of a single electrovalve 81 that can open or close at least one duct of hydraulic fluid 83 between the top chamber 121 and the bottom chamber 122 of a control jack 8.

In this embodiment, the electrovalve 81 is a two-way electrovalve, comprises no check valves and can be aperture duty cycle controlled.

In this embodiment, the two-way electrovalve 81 interacts with an angular position sensor 88 of the crankshaft 9 of the engine in order to regulate the compression ratio, in addition to the position sensor 82 of the control rack 7 and to the computer 84.

The two-way electrovalve 81 comprises two parallel channels, one shutoff by a device with large flow-rate shutoff and slow response, the other shutoff by a device for low flow-rate shutoff and fast response.

In each embodiment, the electrohydraulic device 80 for controlling the compression ratio of the variable compression ratio engine can interact with a ping detector, not shown, in order to independently regulate the compression ratio of each cylinder 110 of the engine, according to its specific physical characteristics.

Also, the electrohydraulic device 80 for controlling the compression ratio of a variable compression ratio engine comprises a degassing electrovalve, not shown, making it possible to connect the top chamber 121 of the control jack 8 with the oil pan of the engine.

Operation:

According to a particular embodiment, two electrovalves 81 are provided per control jack 8 at an inlet and an outlet, each furnished with a check valve 85, 86 as illustrated in FIG. 1, the operation of the electrohydraulic device 80 for controlling the compression ratio is as follows:

The forces exerted on the control rack 7 change direction cyclically, depending on the speed and load at which the variable compression ratio engine operates.

Consequently, the pressure of the top chamber 121 of the control jack 8 becomes cyclically higher and cyclically lower than that of the bottom chamber 122 of the control jack 8.

When, in order to optimize the efficiency, the torque, or reduce the polluting emissions of the variable compression ratio engine, it is necessary to reduce the compression ratio, the opening of the electrovalve 81 for reducing the compression ratio is commanded by the computer 84.

Taking account of the forces applied to the control rack 7, and of the ratchet effect produced by the check valve 86 placed on the same duct 83 as the electrovalve 81 that is kept open, the control rack 7 moves in one or more stages until the position sensor 82 of the control rack 7 indicates to the computer 84 that the position of the control rack 7 correctly corresponds to the required compression ratio.

The operation is identical when it involves raising the compression ratio of the engine, but then involves the opening of the other electrovalve 81 for increasing the compression ratio, interacting with the check valve 85.

If there is a leakage of hydraulic fluid between the top chamber 121 and the bottom chamber 122 of the control jack 8, the position sensor 82 of the control rack 7 informs the computer 84 of the progressive drift in the position of the control rack 7.

Beyond a certain difference between the setpoint position and the real position of the control rack 7, the computer 84 opens either the electrovalve 81 for reducing the compression ratio or the electrovalve 81 for increasing the compression ratio in order to reestablish the setpoint position of the control rack 7.

If a leakage of hydraulic fluid occurs between either one of the top chamber 121 or bottom chamber 122 of the control jack 8 and the outside of the jack, the leakage is automatically compensated for by provision of hydraulic fluid into the chamber opposite to the chamber that leaks, the fluid originating from a hydraulic unit as described, for example, in patent application FR 06/00714 belonging to the applicant, and being provided via one or other of the booster check valves 185, 188.

The second variant embodiment set out in FIG. 2 operates according to the same principle as that previously described in FIG. 1, except that the functions of the distinct electrovalves 81 are in this case performed by a single electrovalve 81 comprising an electrically-controlled spool 87 with two inlets and two outlets.

It is, however, different from the embodiment set out in FIG. 3, which provides for the deletion of the check valves 85, 86 to the benefit of an angular position sensor 88 of the crankshaft 9 of the variable compression ratio engine, it being understood that this member already exists in most modern engines.

According to the particular embodiment set out in FIG. 3, a single two-way electrovalve 81 is provided, the electrovalve being capable of opening and closing sufficiently rapidly to allow the movement of the control rack 7 only for a few degrees of angular movement of the crankshaft 9.

According to the embodiment set out in FIG. 3, the computer 84 incorporates in its memory the ranges of angular position of the crankshaft 9 during which the force applied to the control rack 7 goes in the direction of increasing or reducing the compression ratio when the duct that connects the top chamber 121 and the bottom chamber 122 of the control jack 8 is open.

According to this embodiment, the mapping of the direction of the force applied to the control rack 7 that the computer 84 contains covers the whole range of operating speed and load of the variable compression ratio engine.

When, in order to optimize the efficiency, the torque, or reduce the polluting emissions of the variable compression ratio engine, it is necessary to reduce the compression ratio of the engine, the computer 84 commands the opening of the two-way electrovalve 81 only when the angular position of the crankshaft 9 coincides with a force applied to the control rack 7, which goes in the direction of reducing the compression ratio.

Conversely, to increase the compression ratio of the variable compression ratio engine, the computer 84 commands the opening of the two-way electrovalve 81 only when the angular position of the crankshaft 9 coincides with a force applied to the control rack 7, which goes in the direction of increasing the compression ratio.

These two operations occur and are repeated as long as necessary and until the control rack 7 is moved in one or more stages until the position sensor 88 of the control rack 7 indicates to the computer 84 that the position of the control rack 7 correctly corresponds to the required compression ratio.

It should, moreover, be understood that the foregoing description has been given only as an example and that it in no way limits the field of the invention, which the user would not depart from, by replacing the described execution details by any other equivalent.

What is claimed is:

1. A method of controlling a compression ratio of a variable compression ratio engine, the method comprising:

measuring an angular position of a crankshaft of the engine;

opening at least one electrovalve configured and positioned to open or close at least one hydraulic fluid duct extending between a top chamber above a jack piston connected to a control rack and a bottom chamber below the jack piston to reduce the compression ratio of the engine only when a measured angular position of the crankshaft coincides with a force being applied to the control rack which urges the control rack to move in a direction that reduces the compression ratio of the engine;

opening the at least one electrovalve to increase the compression ratio of the engine only when a measured angular position of the crankshaft coincides with a force being applied to the control rack which urges the control rack to move in a direction that increases the compression ratio of the engine; and repeating at least one of opening the at least one electrovalve only when a measured angular position of the crankshaft coincides with a force being applied to the control rack which urges the control rack to move in the direction that reduces the compression ratio of the engine and opening the at least one electrovalve only when a measured angular position of the crankshaft coincides with a force being applied to the control rack which urges the control rack to move in the direction that increases the compression ratio of the engine until a position of the control rack corresponds to a required compression ratio of the engine.

2. The method of claim 1, wherein repeating opening the at least one electrovalve causes the control rack to move in one or more stages.

3. The method of claim 1, wherein opening the at least one electrovalve comprises sending an electrical signal to the at least one electrovalve from a computer operatively connected to the at least one electrovalve.

4. The method of claim 3, wherein measuring the angular position of the crankshaft comprises measuring the angular position of the crankshaft with a crankshaft position sensor operatively connected to the computer.

5. The method of claim 3, further comprising measuring the position of the control rack.

6. The method of claim 5, wherein measuring the position of the control rack comprises measuring the position of the control rack with a control rack position sensor operatively connected to the computer.

7. The method of claim 6, wherein measuring the position of the control rack with the control rack position sensor operatively connected to the computer comprises measuring the position of the control rack to detect a difference between a setpoint position of the control rack and a real position of the control rack resulting from leakage of hydraulic fluid between the top chamber and the bottom chamber.

8. The method of claim 7, further comprising opening the at least one electrovalve in response to a difference between a setpoint position of the control rack and a real position of the control rack indicated by the control rack position sensor.

9. The method of claim 3, further comprising storing in a memory of the computer ranges of angular position of the crankshaft coinciding with the force being applied to the control rack which urges the control rack to move in the direction that reduces the compression ratio of the engine and ranges of angular position of the crankshaft coinciding with the force being applied to the control rack which urges the control rack to move in the direction that increases the compression ratio of the engine.

10. The method of claim 9, wherein storing in the memory of the computer ranges of angular position of the crankshaft comprises storing ranges of angular position of the crankshaft coinciding with the force being applied to the control rack over a range operating speeds and loads of the engine.

11. The method of claim 3, further comprising measuring engine pinging with a ping detector operatively coupled to the computer.

12. The method of claim 11, further comprising sending a signal from the computer to reduce the compression ratio of the engine responsive to a signal from the ping detector.

13. The method of claim 1, wherein opening the at least one electrovalve further comprises opening and closing the at least one electrovalve sufficiently rapidly to allow movement of the control rack through only a fraction of a complete rotation of the crankshaft.

14. The method of claim 1, wherein opening the at least one electrovalve comprises opening one electrovalve comprising two inlets and two outlets which define two independent circuits and a three-position spool.

15. The method of claim 1, wherein the at least one electrovalve comprises a two-way valve.

16. The method of claim 1, wherein the at least one electrovalve comprises no check valves.

17. A method of controlling a control rack of a variable compression ratio engine, the method comprising:

measuring an angular position of a crankshaft of the engine;

opening at least one electrovalve to open at least one hydraulic duct between a top chamber above a jack piston connected to the control rack and a bottom chamber below the jack piston only when the angular position of the crankshaft coincides with a force being applied to the control rack in a direction in which movement of the control rack causes the compression ratio of the engine to one of increase or decrease;

closing the at least one electrovalve when the angular position of the crankshaft coincides with a force being applied to the control rack in a direction in which movement of the control rack causes the compression ratio of the engine to the other of increase or decrease;

repeating opening the at least one electrovalve and closing the at least one electrovalve until the control rack is in a position corresponding to a selected compression ratio of the engine.

18. The method of claim 17, wherein the at least one electrovalve comprises a two-way valve.

19. The method of claim 17, wherein the at least one electrovalve comprises no check valves.

* * * * *